United States Patent [19]

Göransson et al.

[11] Patent Number: 4,615,745

[45] Date of Patent: Oct. 7, 1986

[54] METHOD OF REDUCING THE PORE DENSITY IN A CASTING

[75] Inventors: Michael Göransson, Kvicksund; Jan Nilsson, Robertsfors, both of Sweden

[73] Assignee: ASEA Aktiebolag, Västerås, Sweden

[21] Appl. No.: 796,120

[22] Filed: Nov. 8, 1985

[30] Foreign Application Priority Data

Nov. 9, 1984 [SE] Sweden ..... 8405604

[51] Int. Cl.[4] ..... C21D 1/53

[52] U.S. Cl. ..... 148/4; 148/13; 432/205

[58] Field of Search ..... 148/4, 3, 13, 20.6, 148/11.5 R, 11.5 A, 11.5 M; 432/205, 197, 215

[56] References Cited

U.S. PATENT DOCUMENTS 2,273,500 2/1942 Umlandt ..... 432/197
4,250,610 2/1981 Wilbers et al. ..... 148/11.5 R
4,349,333 9/1982 Bowles ..... 432/205
4,379,725 4/1983 Kemp ..... 148/4

*Primary Examiner*—Melvyn J. Andrews
*Assistant Examiner*—S. Kastler
*Attorney, Agent, or Firm*—Watson, Cole, Grindle & Watson

[57] ABSTRACT

A casting (e.g. of aluminum or aluminum alloy) is made at least approximately free from pores by being subjected, in heated state, to isostatic compression in a liquid pressure medium. A rapid pressing operation of under one minute can be achieved if the casting is placed in a container, the container and the casting are heated to the required compression temperature before they are thereafter placed in a press chamber of a fast-acting press. When liquid pressure medium is fed to the press chamber and the necessary pressure is applied thereto, the pressure medium flows into the interior of the container via a number of channels in its wall and is simultaneously heated to the necessary temperature, prior to its contacting the casting.

15 Claims, 2 Drawing Figures

METHOD OF REDUCING THE PORE DENSITY IN A CASTING

TECHNICAL FIELD

The present invention relates to a method of making a casting (e.g. of aluminum or aluminum alloy) at least approximately free from pores by subjecting the casting, in a heated state, to isostatic pressure.

DISCUSSION OF PRIOR ART

Aluminum castings are currently manufactured mainly by two methods, namely, by die casting or chill casting. With both methods a porous casting results, the pores weakening the casting. Among other things, the fatigue strength of the casting is reduced by the pores. It is known that porous castings can be densified by subjecting the castings to a hot isostatic compression. In the known method, the casting is placed in the press chamber of a press of autoclave type, whereafter the casting is heated within the press chamber to the necessary temperature for pressure treatment and is then subjected to the necessary pressure in the press chamber, usually via a gaseous pressure medium. Such an isostatic pressing operation is a relatively slow process.

The present invention is based on the realization that the treatment time for densifying a casting by isostatic compression can be drastically reduced by the simultaneous use of a liquid pressure medium, with its inherent low compressibility, and a press with a rapid pressure-increasing capacity such as a piston press, provided that the casting can be brought to the temperature necessary for rapid densifying without the liquid pressure medium having to be heated, in its entirety, up to this temperature.

SUMMARY OF THE INVENTION

According to the present invention, the casting is heated while located within a special container before the container with its casting, is located in the press chamber of the fast-acting press and the liquid pressure medium is supplied to the press chamber. In at least one of the walls of the container, a number of through-channels are provided, through which the liquid pressure medium has to pass in order to contact the casting. In its passage through the channels, the pressure medium is heated by the container wall(s) to the necessary temperature, so that the casting is not subjected to any significant temperature reduction on being contacted by the liquid pressure medium. The container is thus utilized as a heat reservoir. Using the method of this invention, only the relatively small volume of pressure medium that passes through the channels needs to be heated to the elevated temperature required in order not to jeopardize the densification of the casting. This results in the process becoming fast. The fact that the rest of the pressure medium does not need to be subjected to the same degree of heating, is an advantage for reasons other than the speeding-up of this process. Among other things, thermal decomposition changes in the pressure medium are reduced.

The method according to the present invention is particularly suitable for densification of light weight metal and light weight metal alloys.

The isostatic compression is suitably carried out at a pressure of at least 100 MPa and preferably at a pressure in the range 100 to 1000 MPa. A pressure in excess of 300 MPa is particularly preferred. The casting and the container are suitably heated to a temperature which lies above 300° C. but below the solidus temperature of the casting material in question. For pure aluminum the maximum temperature is 659° C. and for pure magnesium 651° C. For most aluminum and magnesium alloys a temperature in the range 370° to 550° C. is suitable. The invention is applicable to the densification of castings of all conventional aluminum and magnesium alloys, which are used for castings. Such aluminum alloys contain at least 85 percent by weight Al as well as one or more additional elements which form a eutectic with the aluminum, normally Si, Cu and Mg. Examples of such alloys are an alloy containing 7 percent by weight Si and 0.37 percent by weight Mg, the balance being Al; an alloy containing 4.5 percent by weight Cu, 1.5 percent by weight Mg and 2 percent by weight Ni, the balance being Al, and an alloy containing 9 percent by weight Si, 0.5 percent by weight Mg and 1.8 percent by weight Cu, the balance being Al. And such magnesium alloys contain at least 85 percent by weight Mg as well as one or more additional elements which form a eutectic with the aluminum, normally, Zn, Zr, Al, Mn and Th. Examples of such alloys are an alloy containing 4.6 percent by weight Zn an 0.7 percent by weight Zr, the balance being Mg; an alloy containing 10 percent by weight Al and 0.1 percent by weight Mn, the balance being Al; an alloy containing 6 percent by weight Al, 0.15 percent by weight Mn and 3 percent by weight Zn, the balance being Mg, and an alloy containing 3.3 percent by weight Th and 0.7 percent by weight Zr, the balance being Mg.

The liquid pressure medium may advantageously consist of a vegetable or animal oil or of a mineral oil. Such pressure media also function as lubricant. It would be possible, per se, to use other liquid pressure media. Among oils, those which have good thermal stability and for which the fire risk is small are particularly preferred. Especially preferred is castor oil, but also palm oil and colza oil may be used to advantage.

The free volume in the container, available for the liquid pressure medium, between the casting and the inner walls of the container is normally considerably smaller than the volume of the material making up the container and suitably constitutes at most 30% and preferably at most 20% of the volume of said material.

The free volume available for the liquid pressure medium between the casting and the inner walls of the container is suitably considerably smaller than the volume of pressure medium in the piston press. By taking steps to make the volume in the container, which is available for the pressure medium, small in relation to the volume of the material making up the container and in relation to the volume of pressure medium in the piston press, a rapid heating of the pressure medium which comes into contact with the casting is made possible, whereas the remainder of the pressure medium in the press need not be subjected to a heating which may, in course of time, become detrimental. Part of the material within the container may consist of separate filling bodies which are arranged between the casting and the actual container walls. The material in the separate filling bodies is then included with the material making up the container when calculating the total volume of material making up the container. When filling bodies are used, they are suitably of the same material as the material from which the container walls are made. The container is preferably made of a metallic material with a higher melting point than that of the casting, for example copper, steel or cast iron when densifying castings of light weight metals and light weight metal alloys.

Suitably, any wall of the container which contains the channels is formed with a greater thickness than the other walls thereof.

Desirably, the channels in the container wall(s) are arranged to be longer than the thickness of the wall in which they are located.

BRIEF DESCRIPTION OF THE DRAWING

The invention will be explained, in greater detail, by way of example, with reference to the accompanying schematic drawing, FIG. 1 of which shows a sectional view of a press for carrying out the present invention, and FIG. 2 a modified form of just part of the container shown in FIG. 1.

DESCRIPTION OF PREFERRED EMBODIMENT

Figure 1:
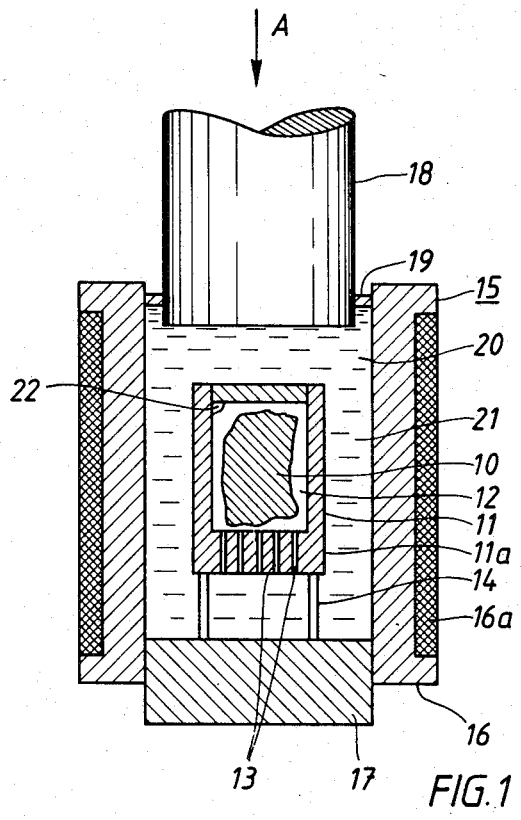

A chilled casting 10 of an aluminum alloy containing 7 percent by weight Si, 0.37 percent by weight Mg, the balance being Al (Al-Si7Mg), is placed in a steel container 11. The volume of the space 12 left between the internal walls of the container 11 and the casting 10 constitutes about 10% of the volume of the steel making up the container 11. In one wall 11*a* of the container, a plurality of channels 13 for pressure medium are provided. These channels 13 each have a diameter of about 4 mm. The wall 11*a*, in which the channels are arranged, has a greater thickness than the outer walls of the container 11 in order for the pressure medium to be heated sufficiently before it contacts the casting 10. The container 11, with its casting 10, is heated up to a temperature of about 500° C. and is then placed on support means 14 in a piston press 15.

The piston press 15 comprises a cylinder 16, which is provided with a wire-wound reinforcing mantle 16*a*, a bottom plate 17, which is in liquid-tight sealing engagement with the cylinder 16, and a movable piston 18. The integers 16, 17, 18 and 19 define a press chamber 20 that surrounds the container 11. Between the cylinder 16 and the piston 18, an annular seal 19 is provided. The piston press 15 is placed in a hydraulic press (not shown), in which there is a cylinder with a piston for applying a force, in the direction of the arrow A, on the piston 18.

After the container 11 with its casting 10 has been heated and placed in the press chamber 20 in the piston press, a liquid pressure medium 21, in the exemplified case consisting of castor oil, is supplied to the press chamber and a pressure of about 400 MPa is quickly generated in the press chamber by means of the piston 18. The castor oil, which is supplied at room temperature or heated somewhat, passes, via the channels 13 in the container 11, into the free space 12 in the container available for the pressure medium. In passing through the channels 13, the castor oil is heated to a temperature close to 500° C. As soon as the pressure medium completely surrounds the casting 10, the casting is subjected to an isostatic pressure, removing the porosity thereof and rendering the casting at least approximately free of pores. The process time for the treatment of the casting in the piston press can be made to be less than 1 minute.

Figure 2:
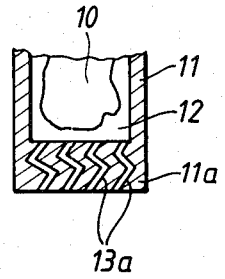

The channels 13 in the container wall 11*a* can be extended, for example by being formed with a zigzag configuration as shown at 13*a* in FIG. 2, or otherwise by being shaped so that the direction of flow of the pressure medium is changed one or more times in its flow through the wall 11*a*.

The volume within the container 11 is partly occupied by the casting 10 and one or more filling bodies (only one of which is shown at 22) so that the free space 12 is less than 30% of the combined volume of the container 11 and the filling bodies 22.

Various modifications of the exemplified process are clearly possible and are embraced by the spirit and scope of the invention as set out in the following claims.

We claim:

1. A method of reducing the porosity of a casting by subjecting the casting, in a heated state to isostatic pressure with a pressure medium, which method comprises locating the casting in a container, heating the container and the casting, thereafter placing the heated casting and surrounding container in a press chamber of a piston press, feeding a liquid pressure medium to the press chamber at a lower temperature than that of the container and casting, and applying pressure to the liquid pressure medium in the press chamber via the piston of the press, the container having at least one wall provided with a plurality of channels which allow the pressure medium to contact the casting, whereby the pressure medium extracts heat from the said at least one wall in passing through the channels into the interior of the said container.

2. A method according to claim 1, in which the free volume in the container, which is available for the inflowing liquid pressure medium, constitutes at most 30% of the volume of the material making up the container.

3. A method according to claim 1, in which the said at least one wall of the container which contains the channels is of greater thickness than the other walls of the container not provided with such channels.

4. A method according to claim 2, in which the said at least one wall of the container which contains the channels is of greater thickness than the other walls of the container not provided with such channels.

5. A method according to claim 1, in which each channel is longer than the thickness of the wall of the container in which it is provided.

6. A method according to claim 2, in which each channel is longer than the thickness of the wall of the container in which it is provided.

7. A method according to claim 3, in which each channel is longer than the thickness of the wall of the container in which it is provided.

8. A method according to claim 4, in which each channel is longer than the thickness of the wall of the container in which it is provided.

9. A method as claimed in claim 1, in which the casting and container are heated to a temperature in the range 370° C. to 550° C. before being located in the press chamber.

10. A method as claimed in claim 9, in which the pressure medium is an oil and the pressure applied thereto lies in the range 100 to 1000 MPa.

11. A method of reducing the concentration of pores in a casting by subjecting the casting at elevated temperature to isostatic compression, via a surrounding pressure medium, the improvement which comprises:

locating the casting in a surrounding container having at least one pressure medium channel therein, heating both the casting and the container to a temperature above 300° C. but below the solidus temperature of the casting material, locating the heated container and casting in a press chamber, filling the press chamber with a liquid pressure medium at a temperature much lower than that of the casting and container, and rapidly applying pressure to the press chamber to force the liquid medium through the channels in the heated container to be heated thereby and thus to cause collapse of at least some of the pores in the casting and effect a densifying of the casting.

12. A method as claimed in claim 11, in which the liquid medium is an oil and the maximum pressure applied thereto exceeds 300 MPa.

13. A method as claimed in claim 12, in which the volume available within the container for inflowing pressure medium is not more than 20% of the volume of the material making up the container.

14. A method as claimed in claim 1, in which the casting consists of a material selected from the group consisting of aluminum, aluminum alloys, magnesium and magnesium alloys.

15. A method as claimed in claim 11, in which the casting consists of a material selected from the group consisting of aluminum, aluminum alloys, magnesium and magnesium alloys.

* * * * *